US005904615A

United States Patent [19]

Jeong et al.

[11] Patent Number: 5,904,615

[45] Date of Patent: May 18, 1999

[54] PAD CONDITIONER FOR CHEMICAL MECHANICAL POLISHING APPARATUS

[75] Inventors: Hea-Do Jeong, Pusan; Dae-Kyun Ahn, Gyeoungnam, both of Rep. of Korea

[73] Assignee: Hankook Machine Tools Co., Ltd., Gyeoungnam, Rep. of Korea

[21] Appl. No.: 08/897,007

[22] Filed: Jul. 18, 1997

[51] Int. Cl.[6] ..... B24B 21/18

[52] U.S. Cl. ..... 451/443; 451/41; 451/56; 451/165; 451/910

[58] Field of Search ..... 451/165, 41, 56, 451/443, 910

[56] References Cited

U.S. PATENT DOCUMENTS

| | | | |
|---|---|---|---|
| 5,245,796 | 9/1993 | Miller et al. | 451/41 |
| 5,547,471 | 8/1996 | Breivogel et al. | 451/443 |
| 5,643,067 | 7/1997 | Katsuoka et al. | 451/56 |
| 5,688,364 | 11/1997 | Sato | 451/165 |

OTHER PUBLICATIONS

"New Polishing Techniques for Plantarization of VLSI Device Wafers"; H. Jeong et al.; 1st International ABTEC Conference; Seoul, Nov. 1993; pp. 80–85.

*Primary Examiner*—Timothy V. Eley
*Assistant Examiner*—George Nguyen
*Attorney, Agent, or Firm*—Bacon & Thomas, PLLC

[57] ABSTRACT

A pad conditioner for a chemical mechanical polishing (CMP) apparatus which is adapted to remove a glazing phenomenon occurring on a polishing pad when wafers are machined using the CMP apparatus. The pad conditioner includes a swing arm pivotally mounted at one end thereof to a desired portion of the upper surface of the chemical mechanical polishing apparatus by a pivot shaft, a rotating oscillator coupled to the other end of the swing arm and adapted to horizontally rotate a conditioning tool mounted thereto while vertically oscillating the conditioning tool, the rotating oscillator including a rotating unit for horizontally rotating the conditioning tool and an oscillation generating unit for vertically oscillating the conditioning tool, and a vertical carrier unit coupled to the other end of the swing arm and adapted to vertically move the rotating oscillator. The pad conditioner finely removes particles of a slurry glazed in voids formed in the surface of a pad by high-frequency oscillations, thereby achieving an extension of the pad life and an improvement in polishing efficiency.

6 Claims, 3 Drawing Sheets

PAD CONDITIONER FOR CHEMICAL MECHANICAL POLISHING APPARATUS

BACKGROUND OF THE INVENTION

1. Field of the Invention

The present invention relates to techniques for polishing wafers such as semiconductor wafers by use of a chemical mechanical polishing (CMP) apparatus, and more particularly to a pad conditioner for a CMP apparatus capable of performing a high-frequency oscillation along with a rotation to remove particles of a polishing material, supplied in the form of a slurry in a wafer polishing process, glazed in voids formed in the surface of a pad, thereby achieving an improvement in polishing efficiency.

2. Description of the Prior Art

A CMP method, which has recently been developed, is being highlighted as a next-generation semiconductor wafer machining method. In accordance with the CMP method, a slurry is interposed between a wafer to be machined and a polishing pad so as to achieve chemical and mechanical removal of protruded surface portions of the wafer. Such a CMP method will now be described in detail in conjunction with a general CMP apparatus shown in FIG. 1.

As shown in FIG. 1, the CMP apparatus includes a turntable 1 provided with a smooth upper surface having a substantially circular shape. A polishing pad 2 is attached to the upper surface of the turntable 1. A wafer carrier 4, to which a wafer 3 to be machined is mounted, is arranged above the polishing pad 2. In the process of polishing the wafer 3 using the CMP apparatus having the above-mentioned configuration, the wafer carrier 4 carried with the wafer 3 is depressed by pressure P against the upper surface of the polishing pad 2 while a slurry 5 is continuously supplied to the central portion of the upper surface of the polishing pad 2. Under this condition, both the wafer carrier 4 and turntable 1 rotate, thereby polishing the wafer 3.

In order to effectively supply the slurry 5 between the wafer 3 and polishing pad 2, the wafer carrier 4 oscillates horizontally, along with the simple rotation of both the turntable 1 and wafer carrier 4.

The slurry 5, which is supplied between the surface of the wafer 3 to be machined and the upper surface of the polishing pad 2, has a composition consisting of fumed silica grains, having a grain size of tens of millimeters to several hundred millimeters, suspended in an alkali aqueous solution, such as KOH, exhibiting a superior etchability to the wafer 3. As the wafer 3 is depressed, the slurry having the above-mentioned composition is changed into a colloidal silica gel. During relative motions of the turntable 1 and wafer carrier 4, $SiO_2$ grains of the colloidal silica gel are fused on the surface of the wafer 3 and then peeled off along with protruded surface portions of the wafer 3, thereby chemically and mechanically removing those protruded surface portions of the wafer 3.

The polishing pad 2 comprises a urethane pad consisting of, for example, a flexible non-woven fabric impregnated with foamed urethane. Such a urethane pad has a plurality of fine voids at the surface thereof. The slurry is received in the voids of the pad so that the pad functions to chemically and mechanically polish the wafer.

In the process of polishing the wafer using the CMP apparatus having the above-mentioned configuration, upright sharp points on the surface of the pad may be worn or laid low by the pressure applied from the wafer to the pad and the oscillation of the wafer. The voids of the pad may also be chocked with the mixture of the slurry and the wafer material separated from the wafer due to the wear of the wafer. That is, a glazing phenomenon occurs.

Where the wear of sharp points on the surface of the pad or the glazing phenomenon occurs, it is difficult for the pad to hold the slurry, thereby degrading the wafer polishing efficiency and the uniformity of the polished wafer surface.

In order to solve such a problem, a method has been proposed, in which the pad is ground at its surface using an electro-deposited diamond disc after being used for several wafers or tens of wafers to remove a surface layer laminated on the pad, thereby removing a glazing phenomenon or other undesirable phenomenons occurring at the pad. That is, a new pad surface is periodically formed in accordance with this method. Thus, a continuous wafer machining is carried out.

However, diamond grains separate from the diamond disc during the conditioning of the pad. Such separated diamond grains form scratches on the surface of a wafer being polished. Furthermore, the pad and wafers may be contaminated by metal grains separated from the disc or a bonding material (SUS or Ni) interposed between the disc and diamond. In some cases, the contaminated pad should be replaced by a new one. However, this results in an increase in costs because the pad is expensive.

Furthermore, when the pad is ground by the diamond disc, a large amount of the pad material is removed. That is, the pad is severely worn. As a result, the life of the pad is shortened. In addition, a lot of time is taken for the conditioning of the pad. This results in a degradation in yield.

SUMMARY OF THE INVENTION

Therefore, an object of the invention is to solve the above-mentioned problems involved in the conditioning of pads required in association with the machining of wafers using the conventional CMP apparatus and to provide a pad conditioner for a CMP apparatus which includes a rotating oscillator for performing a vertical high-frequency oscillation along with a rotation, thereby efficiently removing a glazing phenomenon occurring on a pad used in the CMP apparatus.

In accordance with the present invention, this object is accomplished by providing a pad conditioner for a CMP apparatus which comprises a swing arm pivotally mounted at one end thereof to a desired portion of the upper surface of the CMP apparatus by a pivot shaft, a swing arm drive motor mounted to the pivot shaft of the swing arm and adapted to generate a drive force for the swing arm; and a rotating oscillator coupled to the other end, namely, a free end, of the swing arm.

The rotating oscillator comprises a casing fixedly mounted at an outer surface thereof to the free end of the swing arm, a drive motor installed on the top surface of the casing and provided with a motor shaft extending into the interior of the casing, an oscillation generating unit coupled to the motor shaft of the drive motor and rotatably mounted in the casing, a tool mounting member integrally coupled to the oscillation generating unit, and a vertical carrier mechanism adapted to vertically move the rotating oscillator.

Accordingly, a conditioning tool, which is mounted to the lower end of the rotating oscillator, performs a vertical oscillation in accordance with vertical oscillations generated from the oscillation generating unit, along with a horizontal rotation in accordance with a rotation force from the drive motor.

BRIEF DESCRIPTION OF THE DRAWINGS

Other objects and aspects of the invention will become apparent from the following description of embodiments with reference to the accompanying drawings in which:

FIGS. 5A to 5C are electro-scanned microscopic photographs of pads, respectively, in which FIG. 5A shows an initial surface condition of a new pad, FIG. 5B shows a surface condition of the pad, which has glazed portions, before being processed by a conditioning process, and FIG. 5C shows a surface condition of the pad obtained after being processed by the conditioning process.

DETAILED DESCRIPTION OF THE PREFERRED EMBODIMENTS

Figure 1:
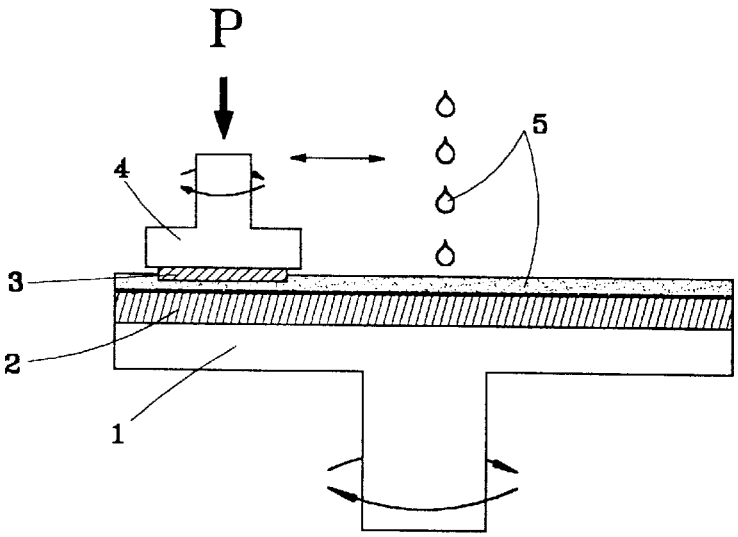
FIG. 1 is a sectional view schematically illustrating a wafer polishing process using a CMP apparatus.
Figure 2:
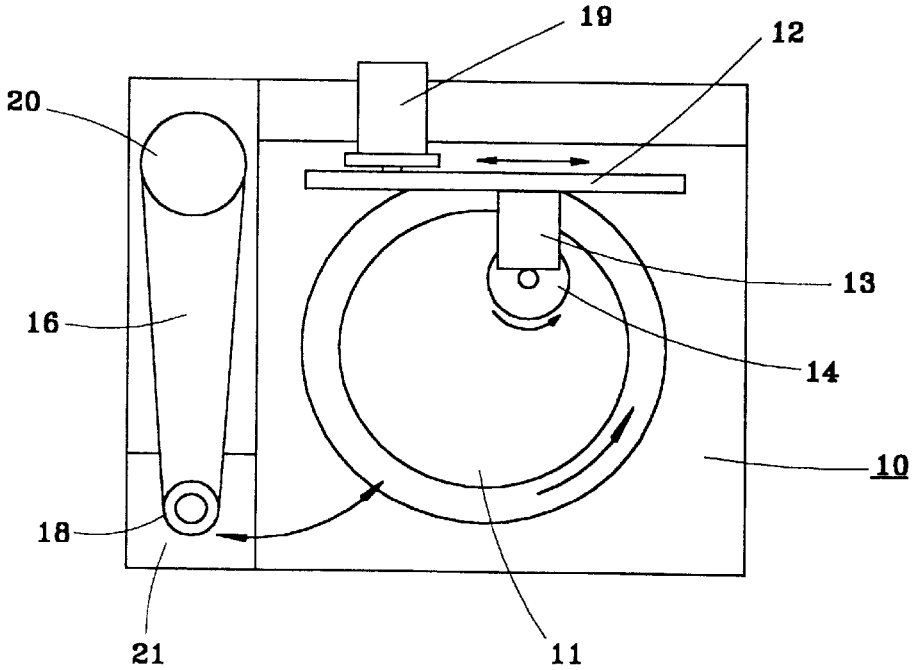
FIG. 2 is a plan view illustrating a CMP apparatus which includes a pad conditioner according to an embodiment of the present invention.
Figure 3:
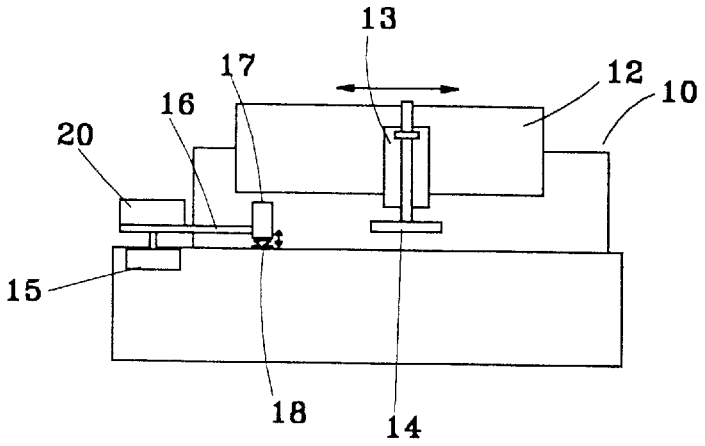
FIG. 3 is a front view illustrating the CMP apparatus shown in FIG. 2.

FIG. 2 is a plan view illustrating a CMP apparatus which includes a pad conditioner according to an embodiment of the present invention. FIG. 3 is a front view illustrating the CMP apparatus shown in FIG. 2.

As shown in FIGS. 2 and 3, the CMP apparatus, which is denoted by the reference numeral 10, includes a polishing pad 11 centrally mounted to the upper surface of the CMP apparatus in such a manner that it is rotatable. The CMP apparatus 10 also includes a carrier driving unit 13 disposed above the pad 11 in such a manner that it is horizontally movable. The horizontal movement of the carrier driving unit 13 is guided by a horizontal carrier mechanism 12. A wafer carrier 14 is mounted to a desired portion of the carrier driving unit 13. The wafer carrier 14 receives a drive force from the carrier driving unit 13 so that it moves vertically while rotating. A swing arm 16 is also pivotally mounted at one end thereof to one lateral end portion of the upper surface of the CMP apparatus 10 by means of a pivot shaft. The swing arm 16 is driven by a drive motor 15. A vertical carrier mechanism 17 is coupled to the other end, namely, the free end, of the swing arm 16. A rotating oscillator 18 is mounted to the vertical carrier mechanism 17 so that it moves vertically by the vertical carrier mechanism 17. The rotating oscillator 18 has an end effector at its lower end.

In FIGS. 2 and 3, the reference numeral 19 denotes a drive motor for generating a drive force to drive the horizontal carrier mechanism 12, the reference numeral 20 denotes an weight mounted to the upper end of the pivot shaft of the swing arm 16 and adapted to balance the swing arm 16, and the reference numeral 21 denotes an end effector clean station.

FIG. 2 shows the state in which the swing arm 16 is not in operation. In this state, the end effector of the rotating oscillator 18 is positioned within the end effector clean station 21 in which a cleaning solution is filled. On the other hand, FIG. 3 shows the state in which the rotating oscillator 18 is disposed above the pad 11 as the swing arm 16 moves counter-clockwise from the state of FIG. 2 by the operation of the drive motor 15. Thus, the rotating oscillator 18 reciprocates between the end effector clean station 21 and the pad 11 by a pivotal movement of the swing arm 16.

Now, the configuration of the rotating oscillator 18 according to the present invention will be described in detail in conjunction with FIG. 4 which is a sectional view illustrating the rotating oscillator 18.

Figure 4:
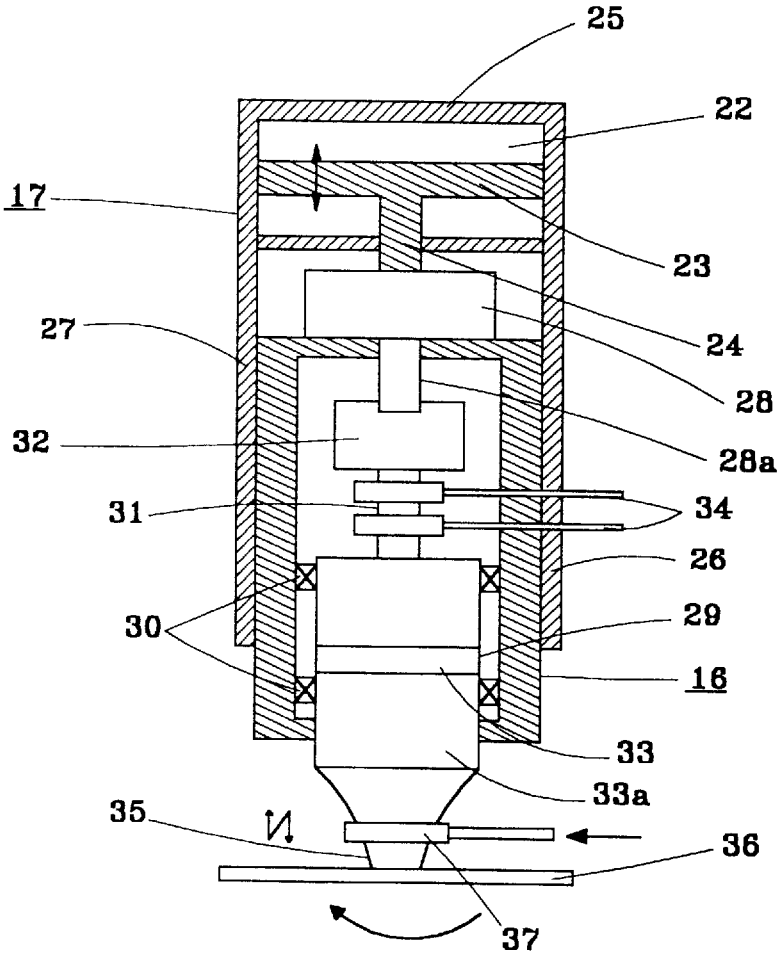
FIG. 4 is a sectional view illustrating a rotating oscillator and a vertical carrier unit included in the pad conditioner according to the present invention.

As shown in FIG. 4, the rotating oscillator 18 is mounted to the vertical carrier unit 17 in such a manner that it is vertically moved by the vertical carrier unit 17. This vertical carrier unit 17 includes a pneumatic cylinder 25 which has a sealed cylinder chamber 22, a piston 23 disposed in the cylinder chamber 22 in such a manner that it reciprocates vertically, and a piston rod 24 coupled at its upper end to the lower surface of the piston 23. The vertical carrier unit 17 also includes a rotating oscillator casing 26 coupled to the lower end of the piston rod 24 in such a manner that it reciprocates vertically in accordance with the vertical reciprocation of the piston 23. An oscillation generating unit 29 is disposed in the rotating oscillator casing 26. The oscillation generating unit 29 is coupled at its upper end to the lower end of the piston rod 24. Accordingly, the rotating oscillator casing 26 reciprocates vertically in accordance with an operation of the pneumatic cylinder 25.

A cylindrical extension 27 extends downwardly from the pneumatic cylinder 25. The rotating oscillator casing 26 is fitted in the cylindrical extension 27 in such a manner that it moves vertically. The cylindrical extension 27 is coupled at its outer surface to the free end of the swing arm 16, so that the pneumatic cylinder 25 is maintained at a fixed vertical position. Accordingly, the rotating oscillator casing 26, which is coupled to the piston rod 24 of the pneumatic cylinder 25, carries out a vertical reciprocation in accordance with the operation of the pneumatic cylinder 25.

A drive motor 28 is mounted to the top surface of the rotating oscillator casing 26 in such a manner that its motor shaft 28*a* extends downwardly into the interior of the rotating oscillator casing 26. The oscillation generating unit 29 is rotatably mounted in the rotating oscillator casing 26 by means of bearings 30 interposed between the outer surface of the oscillation generating unit 29 and the inner surface of the rotating oscillator casing 26.

The oscillation generating unit 29 receives a rotation force from the drive motor 28 via a connecting rod 31 extending upwardly from the oscillation generating unit 29 and a coupling 32 adapted to couple the connecting rod 31 to the motor shaft 28*a*. By such a construction, the oscillation generating unit 29 rotates in the interior of the rotating oscillator casing 26 by the drive force of the drive motor 28.

The oscillation generating unit 29 includes an oscillation generating element 33 for high-frequency oscillations or ultrasonic oscillations, and a booster 33*a* for amplifying the oscillations generated from the oscillation generating element 33. These elements 33 and 33*a* of the oscillation generating unit 29 are energized by electric power supplied thereto via brushes 34 which are in contact with the connecting rod 31. The oscillation generating element 33 may be comprised of a piezo-electric transducer. Preferably, the brushes are comprised of carbon brushes.

The oscillation generating unit 29 is designed in such a manner that the lower end thereof, namely, the lower end of the booster 34, is outwardly exposed below the lower end of the cylinder 27 even when it is positioned at its maximum upper position in the cylinder 27. The booster 33*a* has, at its lower end, a horn-shaped tool mounting member 35 integral therewith. A disc or cup-shaped conditioning tool 36 is mounted to the lower end of the tool mounting member 35.

A cooling pipe 37 is arranged around the tool mounting member 35 so as to prevent the tool mounting member 35 from being over-heated during the conditioning operation.

The conditioning tool 36, which is used for the rotating oscillator 18 according to the present invention, may include general tools used in conventional CMP apparatus, knife blade type, diamond bite type, grooved ceramic type and needle type tools. Such tools have a basic disc or cup shape.

A pad conditioning procedure, which is carried out using the pad conditioner having the above-mentioned configuration according to the present invention, will now be described.

First, the vertical carrier unit 17 is driven in the state of FIG. 2, thereby causing the rotating oscillator 18 to move upwardly from the end effector clean station 21. The swing arm drive motor 15 is then driven, thereby pivoting the swing arm 16 in a counter-clockwise direction. As a result, the rotating oscillator 18 is positioned above the pad 11, as shown in FIG. 3.

Thereafter, the drive motor 28 for the rotating oscillator 18 and the oscillation generating unit 29 drives so that the tool mounting member 35 and the conditioning tool 36 mounted thereto oscillate vertically while rotating horizontally. Under this condition, the vertical carrier unit 17 is driven to downwardly move the rotating oscillator 18, thereby causing the conditioning tool 36 to come into contact with the pad 11. Accordingly, the conditioning tool 36 oscillates vertically on the surface of the pad 11 while rotating horizontally. At this time, the swing arm 16 also oscillates vertically. Thus, a conditioning for the pad is carried out.

Such a conditioning operation carried out by the rotating oscillator 18 may be performed in an in-process manner along with a machining of wafers.

As the conditioning tool 36 oscillates at a high frequency by the rotating oscillator 18 while rotating horizontally under the condition in which it is in contact with the upper surface of the pad 11, grain components of a slurry glazed in voids of the pad 11 are separated from those voids. Accordingly, it is possible to achieve a removal of the glazing phenomenon within a short period of time without a wearing of the pad 11.

After a predetermined conditioning time elapses or the removal of the glazing phenomenon is achieved by the above-mentioned conditioning operation within the predetermined conditioning time, the rotating oscillator 18 moves to the end effector clean station 21. At the end effector clean station 21, the slurry left on the lower portion of the rotating oscillator 18 is then removed.

Figure 5A:
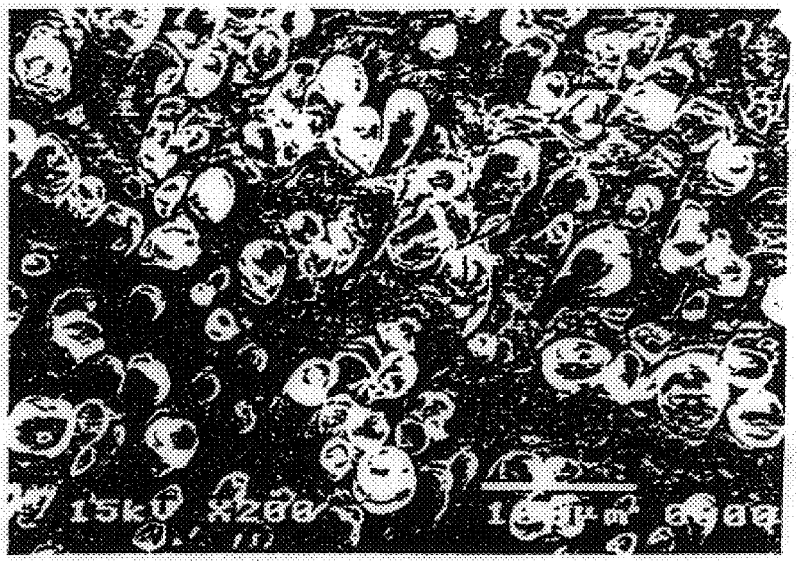
Figure 5B:
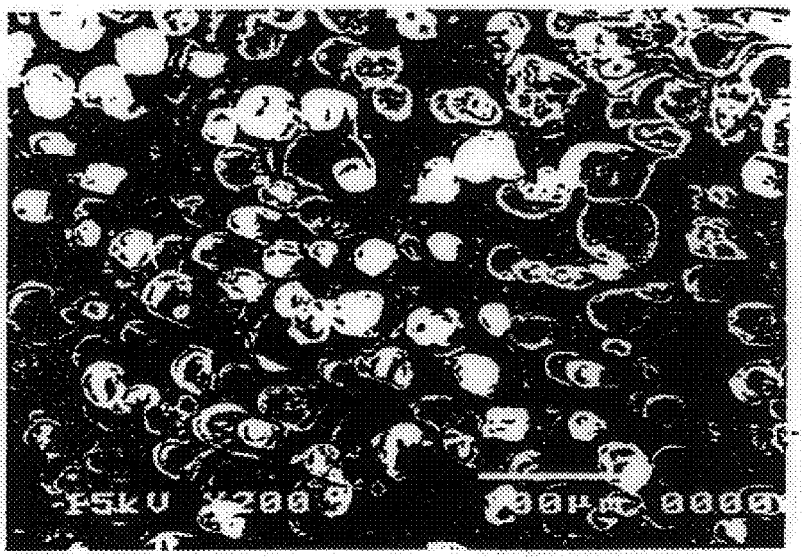
Figure 5C:
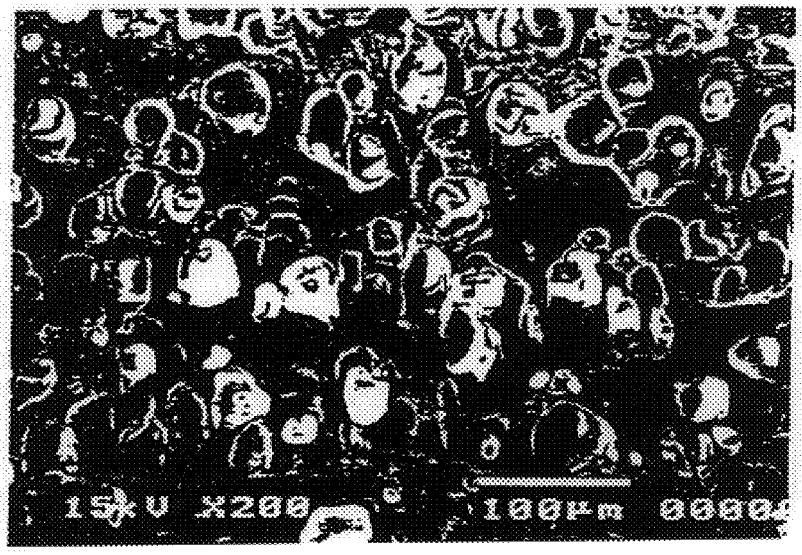

FIGS. 5A to 5C are electro-scanned microscopic photographs of pads, respectively. FIG. 5A shows an initial condition of a new pad whereas FIG. 5B shows a condition of the pad which has glazed portions formed due to a machining of wafers, but not yet processed by a conditioning process. In the photograph of FIG. 5B, the glazed portions of the pad are shown by white circles.

On the other hand, FIG. 5C shows a pad surface condition which is obtained after processing the pad having the surface condition of FIG. 5B by a conditioning process using the pad conditioner according to the present invention. The pad surface condition of FIG. 5C is that obtained after 5 minutes elapses from the initiation of the conditioning process.

Referring to FIGS. 5A to 5C, it is understood that a surface condition similar to the condition of a new pad can be obtained by a conditioning operation carried out even for a short period of time using the pad conditioner of the present invention. When the conditioning operation is carried out for an elongated period of time, the removal of the glazing phenomenon is almost completely achieved.

As apparent from the above description, the pad conditioner of the present invention includes the rotating oscillator 18 which oscillates vertically while rotating horizontally. Accordingly, it is possible to remove a glazing phenomenon occurring on the pad in an in-process manner along with a machining of wafers. That is, it is possible to always obtain a new pad surface involving no grazing phenomenon during the machining of wafers. As a result, a degradation in the wafer machining efficiency is effectively prevented. A superior uniformity is obtained over the whole surface of each wafer machined.

As mentioned above, the removal of the glazing phenomenon is achieved by utilizing high-frequency oscillations of the conditioning tool, which is in contact with the pad, in accordance with the present invention, as compared to the conventional method in which an electro-deposited diamond disc is used. Accordingly, there is no formation of scratches on wafers nor pad contamination due to a separation of diamond grains or metal grains. In accordance with the present invention, the amount of the pad worn during the pad conditioning is very small. That is, the present invention involves a fine pad removal for the pad conditioning. Accordingly, there is an advantage in that the life of the pad is semi-permanent.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A pad conditioner for a chemical mechanical polishing apparatus comprising:

a swing arm pivotally mounted at one end thereof by a pivot shaft to a desired portion of the upper surface of the chemical mechanical polishing apparatus;

a rotating oscillator coupled to the other end of the swing arm and adapted to horizontally rotate a conditioning tool mounted thereto while vertically oscillating the conditioning tool, the rotating oscillator including a rotating unit for horizontally rotating the conditioning tool and an oscillation generating unit for vertically oscillating the conditioning tool; and a vertical carrier united coupled to the other end of the swing arm and adapted to vertically move the rotating oscillator.

2. The pad conditioner in accordance with claim 1, wherein the swing arm reciprocates pivotally by a drive motor mounted to the pivot shaft of the swing arm between a position where the swing arm is above a pad disposed on the upper surface of the chemical mechanical polishing apparatus, and a position where the swing arm is above an effector clean station disposed on the side of the pad.

3. Th pad conditioner in accordance with claim 1, wherein the rotating unit of the rotating oscillator comprises a drive motor, and a connecting rod coupled at an upper end thereof to a motor shaft of the drive motor and at a lower end thereof to the oscillation generating unit, and wherein the oscillation generating unit comprises an oscillation generating element, and a booster having a lower end to which a tool mounting member is coupled.

4. The pad conditioner in accordance with claim 3, wherein the oscillation generating element is a piezo-electric transducer.

5. The pad conditioner in accordance with claim 1, wherein the vertical carrier unit comprises a pneumatic cylinder having a piston and a piston rod coupled at an upper end thereof to the piston, a cylindrical extension extending downwardly from the pneumatic cylinder, the cylindrical extension being fixedly mounted at an outer surface thereof to the other end of the sing arm, and a rotating oscillator casing fitted in the cylindrical extension an coupled to a lower end of the piston rod in such a manner that it reciprocates vertically.

6. The pad conditioner in accordance with claim 1, wherein the oscillation generating unit is rotated horizontally by the rotating unit and produces oscillation in the rotating oscillator casing; and wherein the oscillation generating unit is rotatably mounted in the rotating oscillator casing by means of bearings; and the rotating oscillator casing carries out a vertical reciprocation in accordance with the operation of the pneumatic cylinder.

* * * * *